United States Patent [19]

Taft

[11] 3,970,340

[45] July 20, 1976

[54] HINGE PIN LOCKS

[75] Inventor: Kenneth E. Taft, Stuart, Fla.

[73] Assignee: Lawrence Peska Associates, Inc., New York, N.Y. ; a part interest

[22] Filed: June 19, 1975

[21] Appl. No.: 588,476

[52] U.S. Cl. ..... 292/300

[51] Int. Cl.[2] ..... E05C 19/00

[58] Field of Search..... 292/300, DIG. 39, 145; 16/38, 109, 137, 30; 85/28

[56] References Cited

UNITED STATES PATENTS

| | | | |
|---|---|---|---|
| 420,298 | 1/1890 | Gminder | 292/155 |
| 1,391,304 | 9/1921 | Dowling | 16/137 |
| 1,651,320 | 11/1927 | Brugmann | 292/300 |
| 1,689,031 | 10/1928 | Hossard | 16/30 X |

*Primary Examiner*—Richard E. Moore

[57] ABSTRACT

A tamper proof hinge pin-lock which prevents unauthorized removal of the door from the exterior thereof.

9 Claims, 3 Drawing Figures

HINGE PIN LOCKS

BACKGROUND OF THE INVENTION

This invention relates to a tamperproof hinge pin-lock and particularly to the use of such a lock on doors that open outwardly. The foregoing is most prevalent in the southern states due to weather conditions and insect problems. In the absence of a hinge pin-lock as is here described one can easily gain access to a home through an exterior door thereof by removing the pins from the exposed door hinges and thereafter pry open the door from the hinged side.

The prior art teaches that there have been many attempts to create a tamperproof hinge pin-lock; most efforts in this direction have been directed toward those hinges employed on doors that open inwardly rather than outwardly. In any case, the tamperproof hinge pin-locks of the past have not been easy to manufacture and consequently the cost thereof has discouraged further efforts in developing a relatively simple device.

This invention, however, is directed to a relatively simple, quite inexpensive, easy to install tamperproof hinge lock-pin lock of the type which interengages both the door and door jam when the door is closed to prevent unauthorized entry merely by removal of the hinge pins.

SUMMARY OF THE INVENTION

It is accordingly an object of the invention to avoid one or more drawbacks of the prior art.

It is another object to provide for a simple, inexpensive, easily installable, tamperproof hinge pin-lock.

It is a further object of the invention to provide for a hinge pin-lock which can be installed at any time subsequent to installation of the door.

These and other objects of the invention will become more apparent from the following detailed disclosure and claims, and the accompanying drawings, in which:

DETAILED DESCRIPTION

Figure 1:
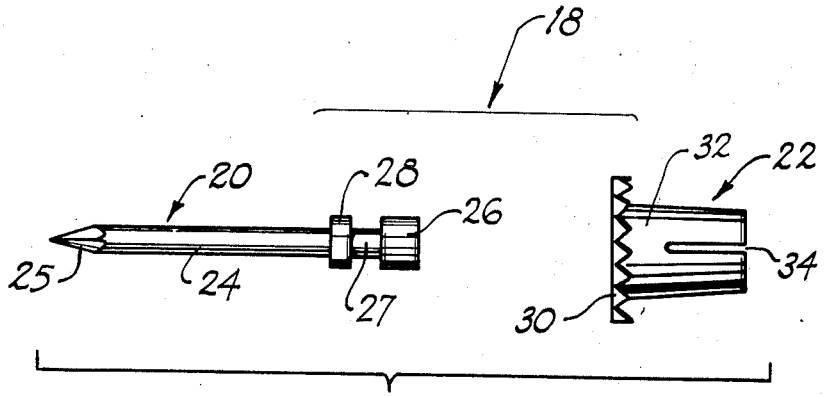
FIG. 1 is a side elevational view of a hinge pin-lock assembly.
Figure 2:
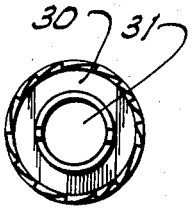
FIG. 2 is a front elevational view of the sleeve member shown in FIG. 1.
Figure 3:
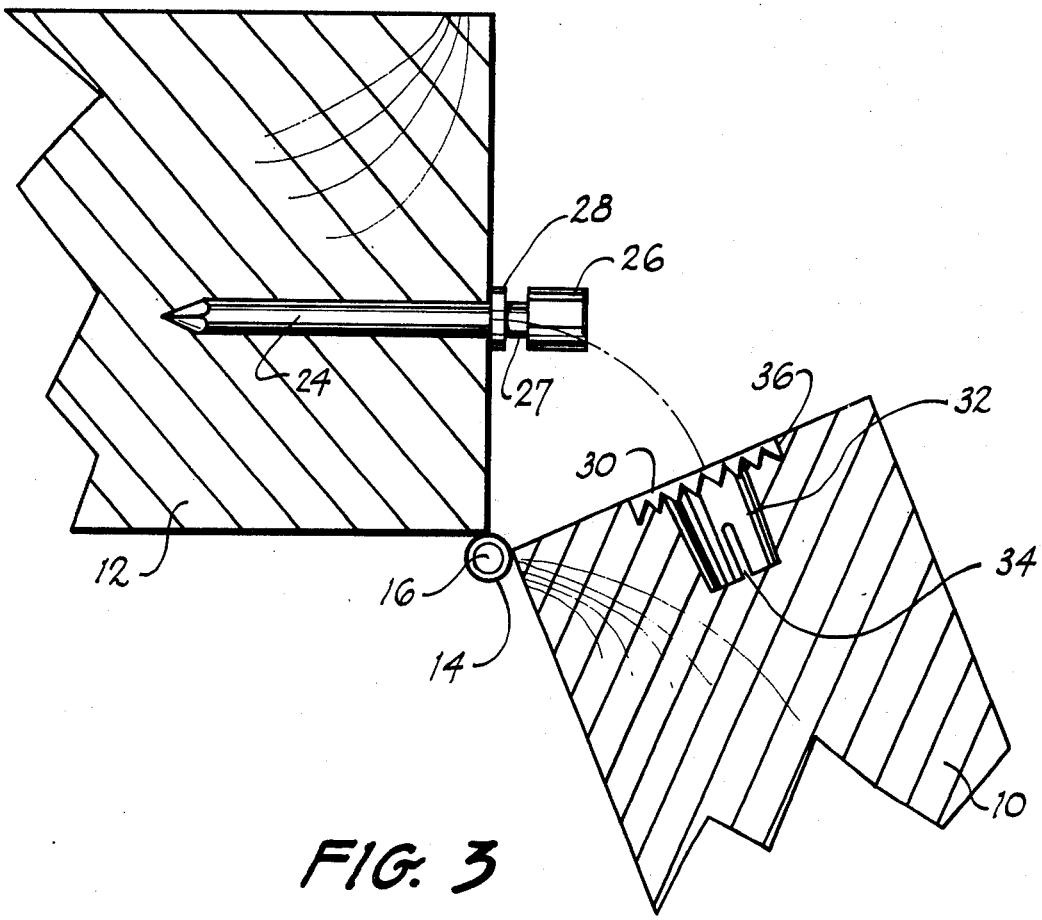
FIG. 3 is a top sectional view taken through the edge portion of a door that is connected to a door jamb and shows the instant hinge pin-lock.

Broadly speaking, the instant invention includes the provision of a hinge pin-lock comprising an elongated member and a sleeve member, the elongated member defining a shaft terminating in an enlarged head, the shaft defining a second head, the second head being disposed on the shaft forward of the first head, the sleeve member defining a substantially toroidal base portion, a side of the base portion being elongated and defining a substantially conically shaped protrusion, the base member being operative to receive at least a portion of the elongated member.

Referring more particularly to the drawings, there is shown a section of a door 10 and door jamb 12 with accompanying hinge in recess 14 and hinge pin 16. The hinge pin-lock assembly 18 is comprised of two sections, a pin member 20 and a sleeve member 22, both of which are preferably constructed of stainless steel, though other suitable steels, metals and hard, impact resistant materials are equally well operative. The pin member 20 is comprised of a substantially cylindrical shaft 24, though a shaft having another shape can also be employed. The shaft portion 24 will be of such length to effectuate secure positioning in the door jamb 12 when set therein; it may if desired have one conically tapered end 25. About one and half inches or greater is ordinarily adequate, i.e., about 1½ to 3½ inches; diameters of about 3/32 to 7/32 are sufficient. It is to be understood that other demeanors are equally as operative and larger pins 20 may be desired for unusually heavy or large doors. The pin 20 defines a shaft 24 which terminates in an enlarged first head 26, the diameter thereof generally be a few 32nds larger than that of the pin 24. Disposed below the enlarged first head 26 there is a second head or enlarged diameter portion 28 which is approximately of the same diameter as the enlarged first head 26, though it need not be. Disposed between the first 26 and second 28 heads is a small section (i.e., about ½ inch) of shaft 27. The sleeve member 22 is generally hat shaped and will define a substantially toroidal shaped base 30 having a diameter of about ⅞ inch which is thereafter elongated and reduced in diameter into a substantially conically shaped protrusion 32. The interior diameter 31 of the opening in the base 30 is about ⅝ inch while the interior diameter of the protrusion is about ¼ inch. For ease of operation the head of the protrusion 32 can have a slot 34 or slots for expansion of the sleeve 22 when the head 26 of the pin member is inserted therein. If desired for ease of installation the sleeve base 30 can be provided with a series of serrations 36 on a flange or lip bent backward of the sleeve or a uniform flange therearound to facilitate introduction of the same into the door 10. The foregoing optional feature will prevent the sleeve base 30 from being deformed when the sleeve 22 is hammered into the recess in the side of the door 10 to accommodate the same.

The hinge lock-pin assembly 18 of the invention can easily be installed as follows:

Drill a ⅛ inch pilot hole about 1 inch above or below each door hinge to avoid splitting door jamb. Make sure that pin will be in the center of door when closed. Install the pin 20 in pilot hole with a hammer until the first head is flush with the door jamb 12. Gently close the door 10 until the head 26 of the pin 20 makes a small indentation mark on the door 10. Drill a ¼ inch hole in the door 10 making sure that indentation mark is the center of the hole. Install sleeve 22 into door 10 with hammer until face of sleeve is flush with door 10. Pins 20 should slide into sleeve 22 in door when door 10 is closed if installed properly.

While several preferred embodiments of the invention have been shown and described herein, it is to be understood that the scope of the invention is not limited to the specific embodiments disclosed and described, as various modifications are apparent.

Having thus described the invention, what I claim is:

1. A hinge pin-lock comprising an elongated member and a sleeve member having one end blocked and adapted to releasably receive a portion of said elongated member, said elongated member defining a shaft terminating at one end in an enlarged annular head, said shaft defining a second head, said second head being disposed on shaft forward of said first head, said sleeve member having a depth about equal to the distance on said shaft from head to head and defining a substantially toroidal base portion, a side of said base portion being elongated and defining a substantially conically shaped protrusion, said base member being operative to slidably engage a portion of said elongated member, the distal end of said head adapted to abut said closed end of said sleeve whereby movement of said member is arrested.

2. A lock as defined in claim 1 wherein said sleeve member is generally hat shaped.

3. A lock as defined in claim 1 wherein said first and second heads are of approximately the same diameter.

4. A lock as defined in claim 1 wherein said base portion contains a flange at one end thereof.

5. A lock as defined in claim 1 wherein the internal diameter of said base portion has an internal diameter greater than the external diameter of said first head.

6. A lock as defined in claim 1 constructed of a substantially impact and shock resistant material.

7. A lock as defined in claim 1 wherein the opposite end of said shaft is beveled at the terminous.

8. A lock as defined in claim 1 wherein said two heads have approximately the same diameter.

9. A lock as defined in claim 1 wherein said closed end of said sleeve defines a transverse slot adapted to permit expansion of said sleeve when said distal end of said first head engages said sleeve.

* * * * *